US006067929A

United States Patent [19]

Fisher

[11] Patent Number: 6,067,929

[45] Date of Patent: May 30, 2000

[54] CEILING TEXTURING DEVICE

[76] Inventor: Harry R. Fisher, 1139 E. 354th St., Eastlake, Ohio 44095

[21] Appl. No.: 08/729,880

[22] Filed: Oct. 15, 1996

Related U.S. Application Data

[63] Continuation-in-part of application No. 08/498,663, Jul. 3, 1995, abandoned.

[51] Int. Cl.[7] ..... B05C 1/06

[52] U.S. Cl. ..... 118/256; 118/200; 118/205; 118/241; 118/242; 118/244; 15/22.2; 15/52.2

[58] Field of Search ..... 118/200, 205, 118/241, 242, 244, 256; 15/22.2, 49.1, 50.2, 52.2, 97.1, 98

[56] References Cited

U.S. PATENT DOCUMENTS

| | | | |
|---|---|---|---|
| 1,047,458 | 12/1912 | Stumpf | 15/52.2 |
| 1,553,456 | 9/1925 | Metrakos | 15/22.2 |
| 1,712,579 | 5/1929 | Nichols | 15/22.2 |
| 2,124,705 | 7/1938 | Locklin | 15/49.1 |
| 2,559,295 | 7/1951 | Grossenbacher | 15/98 |
| 2,670,577 | 3/1954 | McDonough | 15/98 |
| 3,066,339 | 12/1962 | Fukuba | 15/49.1 |
| 3,268,935 | 8/1966 | Ungeheuer | 15/98 |

FOREIGN PATENT DOCUMENTS

| | | | |
|---|---|---|---|
| 241056 | 12/1946 | Switzerland | 15/22.2 |

*Primary Examiner*—Michael P. Colaianni
*Attorney, Agent, or Firm*—John H. Vynalek

[57] ABSTRACT

A ceiling texturing device, comprising a drive, a drive shaft attached to the drive whereby the drive rotates the drive shaft, adjustable reciprocating device attached to the drive shaft such that the rotating motion of the drive shaft is converted to reciprocating motion and the amount of reciprocating motion can be selectively varied, a piston rod attached to the adjustable reciprocating device such that the adjustable reciprocating device moves the piston rod in a reciprocating motion and a ceiling texturing device attached to the piston rod such that the piston rod moves the ceiling texturing device in a reciprocating motion.

23 Claims, 2 Drawing Sheets

CEILING TEXTURING DEVICE

CROSS-REFERENCE TO RELATED APPLICATION

This application is a continuation-in-part of U.S. patent application Ser. No. 08/498,663 filed Jul. 3, 1995 now abandoned.

BACKGROUND OF THE INVENTION

The present invention relates generally to construction devices and, more particularly, to construction devices involving the installation and finishing of ceilings.

One of the final activities in the construction process prior to the substantial completion of a project is the finishing work. The finishing work includes many individual efforts which, in effect, gives the project a distinctive personality and character. In projects where aesthetics are very important, mainly residential and, sometimes, commercial, the finishing of the ceiling of a room requires a great deal of attention. Although there is a wide variety of ceiling tiles available, hand textured ceilings are still in demand. These types of ceilings require a worker to manually apply with a brush material to a ceiling and, in so doing, produce a textured design. This application is difficult, not only due to the fact that the worker must awkwardly reach above himself or herself to reach the ceiling with the brush or other applicating device, but also due to the fact that he or she must manipulate the brush while in that awkward position to develop the distinctive designs. Such manipulation requires the worker to apply the ceiling material in a rapidly repeating and intermittent action of contacting and not contacting the ceiling with the applicating device. At the same time, the particular design may require the twisting or rotating of the applicating device at the time of contact with the ceiling to produce a desired effect.

This type of application is a slow, painstaking one. On projects with large ceiling areas arm fatigue will affect the rate of production and, therefore, is a major factor in labor costs. Also, in the event the ceiling is high, the worker must use a ladder or scaffold and be in the awkward position several feet above the floor. This combined with the prevalence of arm fatigue creates a dangerous situation where the worker may loose his or her balance and fall resulting in a severe or critical injury.

U.S. Pat. No. 1,712,579 to Nichols, discloses a window cleaning appliance which teaches a reciprocating member or rod. Nichols' patent, though, does not disclose a reciprocating means that is adjustable. It does teach the ability to change the length of the handle to reach larger or higher located windows. This, though, does not affect or modify the length of the 'throw' of the reciprocating action which, not only addresses the length that the device can reach, but also, the amount of pressure on the ceiling which directly affects arm fatigue and the type and character of the design. U.S. Pat. No. 2,670,577 to McDonough and U.S. Pat. No. 3,268,935 disclose apparatus for supporting power devices to allow a worker to perform his or her tasks from the floor instead of on a ladder or scaffold. Neither of these patents disclose or claim a reciprocating means, whether adjustable or not, and, actually address only rotating power devices. They would not satisfy the need for a device that adequately addresses the specific demands of ceiling texturing or stippling.

Therefore, a need exists for a ceiling texturing device that allows the application of material to the ceiling in a safe and efficient manner and without the worker being in an awkward position and reducing the amount of fatigue the worker experiences.

SUMMARY OF THE INVENTION

The present invention provides a system to satisfy the aforementioned need.

Accordingly, the present invention is directed to a ceiling texturing device, comprising a variable speed drive means, a drive shaft attached to the drive means whereby the drive means rotates the drive shaft, an adjustable reciprocating means attached to the drive shaft such that the rotating motion of the drive shaft is converted to reciprocating motion and the amount of reciprocating motion can be selectively varied, a piston rod attached to the adjustable reciprocating means such that the adjustable reciprocating means moves the piston rod in a reciprocating motion and ceiling texturing means attached to the piston rod such that the piston rod moves the ceiling texturing means in a reciprocating motion.

In another aspect, the invention is directed to a ceiling texturing device comprising drive means, a drive shaft attached to the drive means whereby the drive means rotates the drive shaft, a right angle drive gear attached to the drive shaft such that the drive shaft rotates the right angle drive gear. A crank having a plurality of predeterminately spaced attachment holes is attached to the right angle drive gear such that the right angle drive gear rotates the crank. A rod bearing is attached to the crank at one of the attachment holes with a connecting arm having first and second ends attached to the rod bearing at the first end such that when the crank rotates it moves the first end of the connecting arm in a circular motion resulting in the second end of the connecting arm moving in a reciprocating motion, the amount of the reciprocating motion varies depending upon which attachment hole the rod bearing is attached. A piston rod is attached to the second end of the connecting arm such that the connecting arm moves the piston rod in a reciprocating motion. Ceiling texturing means is attached to the piston rod such that the piston rod moves the ceiling texturing means in a reciprocating motion.

In yet another aspect, the invention is directed to a ceiling texturing device comprising drive means, a drive shaft attached to the drive means whereby the drive means rotates the drive shaft, a right angle drive gear attached to the drive shaft such that the drive shaft rotates the right angle drive gear. A crank having a plurality of predeterminately spaced attachment holes is attached to the right angle drive gear such that the right angle drive gear rotates the crank. A rod bearing is attached to the crank at one of the attachment holes with a connecting arm having first and second ends attached to the rod bearing at the first end such that when the crank rotates it moves the first end of the connecting arm in a circular motion resulting in the second end of the connecting arm moving in a reciprocating motion, the amount of the reciprocating motion varies depending upon which attachment hole the rod bearing is attached. A piston rod having a first connector is attached to the second end of the connecting arm by a wrist pin such that the connecting arm moves the piston rod in a reciprocating motion toward and away from the crank. A cable having first and second ends is enclosed in a cable sleeve having a second connector whereby the first end of the cable is connected to the piston rod at the first connector and the cable passes through the second connector. A ceiling texturing means having a head connector and a head sleeve attached thereto whereby the second end of the cable is connected to the ceiling texturing means at a head connector and whereby the head sleeve is larger than the cable sleeve to allow the head sleeve to move over the cable sleeve. First spring attaches to the second connector on the cable sleeve and the head connector on the ceiling texturing means such that the cable passes through the first spring and whereby when the piston rod moves in a direction toward the crank it pulls on the cable, and also forces the ceiling texturing means toward the crank, thereby compressing the first spring. When the piston rod moves away from the crank, compression is taken off of the first spring and the first spring forces the ceiling texuring means in the direction away from the crank thereby imparting a reciprocating motion to the head sleeve and the ceiling texturing means.

BRIEF DESCRIPTION OF THE DRAWINGS

Further features of the present invention will become apparent to those skilled in the art to which the present invention relates from reading the following specification with reference to the accompanying drawings in which.

DESCRIPTION OF THE PREFERRED EMBODIMENT

Figure 1:
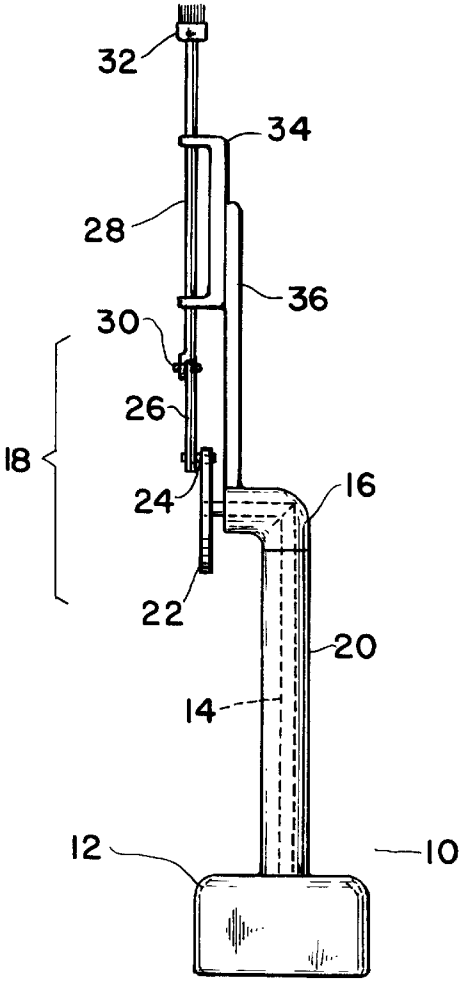
FIG. 1 is an elevation view of the present invention.

Referring now to the drawings and, particularly FIG. 1, there is shown an elevation of the present invention 10. Drive means 12 attaches to a drive shaft 14. The drive shaft 14 may be stiff or flexible, but in FIG. 1 it is shown as stiff. The drive shaft 14 terminates in a right angle drive gear 16 which connects to adjustable reciprocating means 18. The drive shaft 14 is enclosed in a sleeve 20. In the preferred embodiment of the present invention 10, the sleeve 20 extends from the drive means 12 to the right angle drive gear 16 to which it attaches. In the preferred embodiment of the present invention 10, the adjustable reciprocating means 18 has a crank 22, a rod bearing 24 with a connecting arm 26. The connecting arm 26 connects to a piston rod 28 using a wrist pin 30. Ceiling texturing means 32 is attached to the piston rod 28. The drive means 12 rotates the drive shaft 14. The drive shaft 14 rotates the right angle drive gear 16 which, in turn, rotates the adjustable reciprocating means 18. The adjustable reciprocating means 18 converts the rotating motion into reciprocating motion. The adjustable reciprocating means 18 transfers the reciprocating motion to the piston rod 28 through the crank 22, connecting arm 26 and the rod bearing 24. The connecting arm 26 drives the piston rod 28, in a reciprocating motion, toward and away from the crank 22 which moves the ceiling texturing means 32 in the same reciprocating motion. The piston rod 28 reciprocates through a piston guide 34. The piston guide 34 is attached to the right angle drive gear 16 by a support 36. The drive means 12 is variable speed and can be an electric motor or pneumatically or hydraulically powered. Advantageously, the drive means 12 is a ½ horsepower motor. In order to operate the present invention 10, the operator grasps the sleeve 20 and the support 36 and directs the ceiling texturing means 32 to the point of the ceiling that is intended to have a textured finish. The ceiling texturing means 32 may be a brush, sponge or any other means used to apply texturing material.

Figure 2:
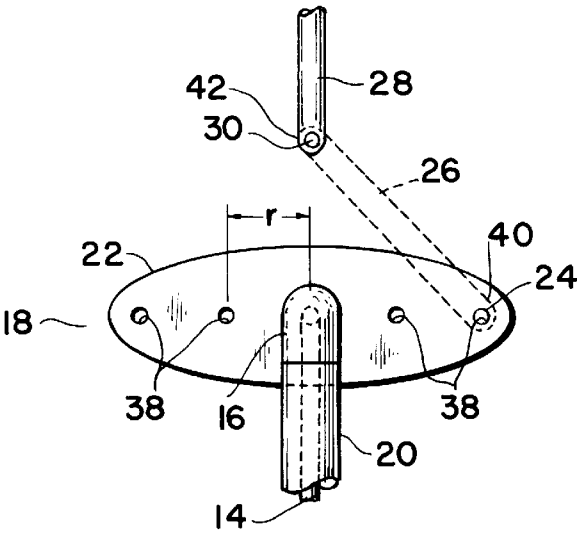
FIG. 2 is a detail view of the adjustable reciprocating means.

Referring now to FIG. 2 there is shown a detail view of the adjustable reciprocating means 18 of the present invention 10. The adjustable reciprocating means 18 is composed of a crank 22 having a plurality of predeterminately spaced attachment holes 38. The first end 40 of the connecting arm 26 is attached to rod bearing 24 which is then connected to one of the attachment holes 38. The second end 42 of the connecting arm 26 is connected through a wrist pin 30 to the piston rod 28. As the right angle drive gear 16 rotates it rotates the crank 22 resulting in the first end 40 of the connecting arm 26 moving in a circular path with the rotation of the crank 22. This circular movement of the first end 40 of connecting arm 26 imparts a reciprocating motion on the second end 42 of the connecting arm 26. The length of the reciprocating motion is equal to the diameter of the circle traced by the first end's 40 circular motion. The attachment holes 38 are located at various predetermined distances "r" from the point at which the right angle drive gear 16 connects to the crank 22. The distance "r" is the radius of the circular motion. Therefore, attaching the first end 40 of the connecting arm 26 and rod bearing 24 to a particular attachment hole 38 will determine the radius and diameter of the circle traced by the circular motion of the first end 40 of the connecting arm 26 and the amount of the reciprocating motion imparted on the second end 42 of the connecting arm 26. The amount of reciprocating motion of the second end 42 of the connecting arm 26 will be the same as the length of throw, and reciprocating speed, of the piston rod 28 and, ultimately, the ceiling texturing means 32 (not shown on FIG. 2).

Figure 3:
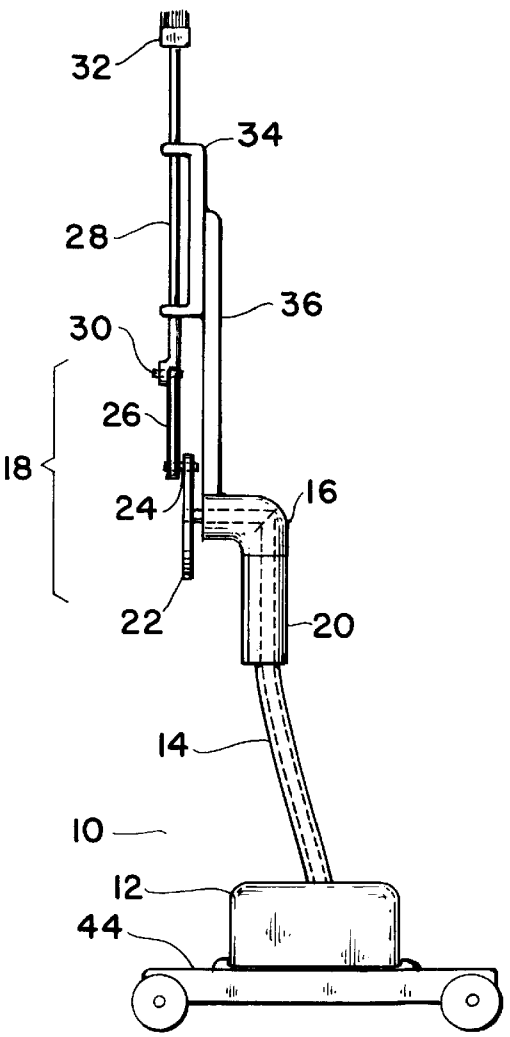
FIG. 3 is a detail view of the present invention mounted on a movable platform.

Referring now to FIG. 3, there is shown another preferred embodiment of the present invention 10. In FIG. 3 the present invention 10 is shown with a movable platform 66. In this embodiment the drive means 12 is mounted on the movable platform 66. The drive shaft 14 is flexible. As in FIG. 1, the drive shaft 14 is enclosed in a sleeve 20 but in this embodiment the sleeve 20 encloses only a portion of the drive shaft 14. The right angle drive gear 16; adjustable reciprocating means 18 with its crank 22, rod bearing 24 and connecting arm 26; piston rod 28; and piston guides 34 are connected and operate in the same manner as described with reference to FIG. 1. In this embodiment, the movable platform 66 with the drive means 12 mounted thereon is moved to a location in the area where the ceiling is to be textured. The operator grasps the present invention 10 by the sleeve 20 and support 36 and directs the ceiling texturing means to the area of the ceiling to be textured. In this embodiment, though, the operator does not have to lift the drive means 12 to operate the present invention 10. Typically, the operator will position the movable platform 66 with the drive means 12 centrally in the area to be textured. The operator will then have a range of motion dependent upon the length of the drive shaft 12. The drive shaft 12 can be any size but in this embodiment of the present invention 10 it is ½ inches in diameter by 10 feet long.

Figure 4A:
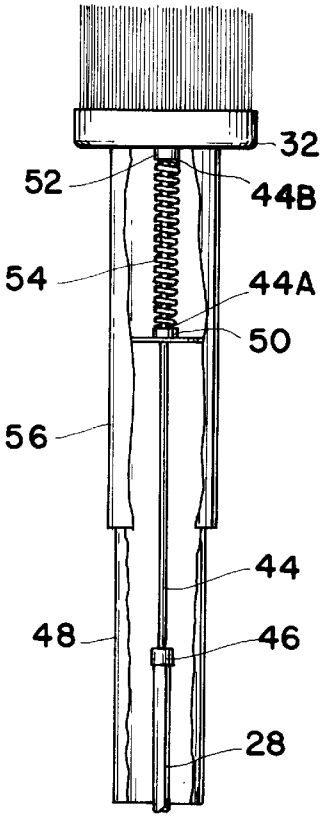
FIG. 4A is detail of a portion of the invention shown in FIG. 4 with a cut-away view showing internal connections.
Figure 4:
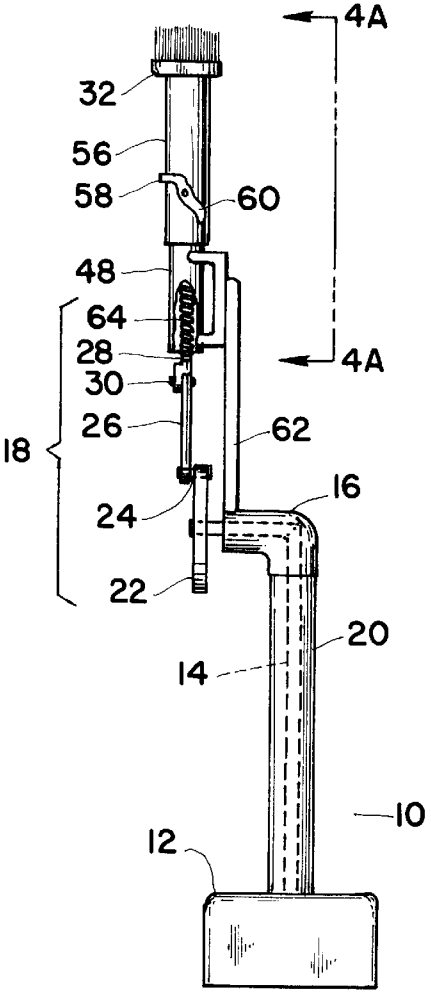
FIG. 4 is an elevation view of another embodiment of the present invention

Referring now to FIG. 4 and FIG. 4A, there is shown in elevation another embodiment of the present invention 10, and a detail of a portion of the invention with a cut-away view showing internal connections, respectively. Drive means 12, drive shaft 14, right angle drive gear 16, adjustable reciprocating means 18, crank 22, rod bearing 24, connecting arm 26, piston rod 28, and wrist pin 30 are connected and operate in the same manner as describes when discussing FIG. 1. In this embodiment, though, piston rod 28 connects to first end 44*a* of cable 44 at first connector 46. The piston rod 28 and cable 44 are enclosed in cable sleeve 48. A second connecter 50 is attached to one end of the cable sleeve 48 and the cable 44 passes through the second connecter 50 with the second end 44*b* of the cable 44 connecting to head connecter 52. Head connecter 52 attaches to ceiling texturing means 32 One end of first spring 54 attaches to second connecter 50 with the other end attaching to head connecter 52. Head sleeve 56 attaches to ceiling texturing means 32 and is sized larger than cable sleeve 48 such that the head sleeve 56 fits over the cable sleeve 48. Cable sleeve 48 has a guide 58 which travels through a slot 60 in head sleeve 56.

When the piston rod 28 moves toward the crank 22 it pulls on cable 44, which, since the cable 44 is connected to the ceiling texturing means 32, also forces the ceiling texturing means 32 toward the crank 22, thereby compressing the first spring 54. When the piston rod 28 moves away from the crank 22, compression is taken off of the first spring 54 and it forces the ceiling texuring means 32 away from the crank 22, thereby imparting a reciprocating motion to the ceiling texturing means 32. The head sleeve 56 is connected to the ceiling texturing means 32 and, therefore, moves in the same fashion therewith. The head sleeve 56 moves over the cable sleeve 48. The slot 60 in the head sleeve 56 is formed such that when the head sleeve 56 moves in a reciprocating motion the guide 58 on the cable sleeve 48 imparts a twisting motion to the head sleeve 56 and therefore, the ceiling texturing means 32. Bracket 62 is attached to sleeve 20 and cable sleeve 48. Second spring 64 is connected to cable sleeve 48 and piston rod 28. The second spring 64 keeps tension on the piston rod 28 and the wrist pin 30. Second spring 64 can also be connected between piston rod 28 and bracket 62. The second spring 64 provides for a taut connection between crank 22, connecting arm 26 and piston rod 28 and precludes the connecting arm 26 from binding with the piston rod 28.

Now that the invention has been described, variations and modifications will become apparent to those skilled in the art. It is intended that such variations and modifications be encompassed within the scope of the appended claims.

What is claimed is:

1. A ceiling texturing device, comprising:

a) drive means;

b) a drive shaft attached to said drive means whereby said drive means rotates said drive shaft;

c) adjustable reciprocating means attached to said drive shaft such that the rotating motion of said drive shaft is converted to reciprocating motion and such that the amount of the reciprocating, motion can be selectively varied;

d) a piston rod attached to said adjustable reciprocating means such that said adjustable reciprocating means moves said piston rod in a reciprocating motion; and e) ceiling texturing means attached to said piston rod such that said piston rod moves said ceiling texturing means in a reciprocating motion rapidly and intermittantly contacting and not contacting a ceiling.

2. The ceiling texturing device of claim 1 wherein said drive means is variable speed.

3. The ceiling texturing device of claim 1 wherein said drive means is an electric motor.

4. The ceiling texturing device of claim 1 wherein said drive means is pneumatically powered.

5. The ceiling texturing device of claim 1 wherein said drive means is hydraulically powered.

6. The ceiling texturing device of claim 1 further comprising a right angle drive gear attached between said drive shaft and said adjustable reciprocating means such that said drive shaft rotates said right angle drive gear which in turn rotates said adjustable reciprocating means.

7. The ceiling texturing device of claim 6 further comprising a sleeve attached to said right angle drive gear and enclosing said drive shaft.

8. The ceiling texturing device of claim 1, further comprising:

a) at least one piston guide through which said piston rod reciprocates; and b) a support attached to said at least one piston guide.

9. The ceiling texturing device of claim 1 further comprising a movable dolly on which said drive means is mounted.

10. The ceiling texturing device of claim 9 wherein said drive shaft is flexible.

11. A ceiling texturing device, comprising:

a) drive means;

b) a drive shaft attached to said drive means whereby said drive means rotates said drive shaft;

c) a right angle drive gear attached to said drive shaft such that said drive shaft rotates said right angle drive gear;

d) a crank having a plurality of predeterminately spaced attachment holes and attached to said right angle drive gear such that said right angle drive gear rotates said crank;

e) a rod bearing attached to said crank at one of said attachment holes;

f) a connecting arm having first and second ends attached to said rod bearing at said first end such that when said crank rotates it moves said first end of said connecting arm in a circular motion resulting in said second end of said connecting arm moving in a reciprocating motion, and such that the amount of the reciprocating motion varies depending upon which said attachment hole said rod bearing is attached;

g) a piston rod attached to said second end of said connecting arm such that said connecting arm moves said piston rod in a reciprocating motion; and h) ceiling texturing means attached to said piston rod such that said piston rod moves said ceiling texturing means in a reciprocating motion.

12. The ceiling texturing device of claim 11 wherein said drive means is variable speed.

13. The ceiling texturing device of claim 11 wherein said drive means is an electric motor.

14. The ceiling texturing device of claim 11 wherein said drive means is pneumatic.

15. The ceiling texturing device of claim 11 wherein said drive means is hydraulic.

16. The ceiling texturing device of claim 11 further comprising a sleeve attached to said right angle drive gear and enclosing said drive shaft.

17. The ceiling texturing device of claim 11, further comprising:

a) at least one piston guide through which said piston rod reciprocates; and b) a support attached to said piston guides and said right angle drive gear.

18. The ceiling texturing device of claim 11 further comprising a movable dolly on which said drive means is mounted.

19. The ceiling texturing device of claim 18 wherein said drive shaft is flexible.

20. The ceiling texturing device of claim 19 wherein said drive shaft is about 0.5 inches in diameter and 10 feet in length.

21. A ceiling texturing device, comprising:

a) drive means;

b) a drive shaft attached to said drive means whereby said drive means rotates said drive shaft;

c) a right angle drive gear attached to said drive shaft such that said drive shaft rotates said right angle drive gear;

d) a crank having a plurality of predeterminately spaced attachment holes and attached to said right angle drive gear such that said right angle drive gear rotates said crank;

e) a rod bearing attached to said crank at one of said attachment holes;

f) a connecting arm having first and second ends attached to said rod bearing at said first end such that when said crank rotates it moves said first end of said connecting arm in a circular motion resulting in said second end of said connecting arm moving in a reciprocating motion, and such that the amount of the reciprocating motion varies depending upon which said attachment hole said rod bearing is attached;

g) a piston rod having a first connector attached to said second end of said connecting arm by a wrist pin such that said connecting arm moves said piston rod in a reciprocating motion toward and away from said crank;

h) cable having first and second ends enclosed in a cable sleeve having a second connector whereby said first end of said cable is connected to said piston rod at said first connector and said cable passes through said second connector;

i) ceiling texturing means having a head connector and a head sleeve attached thereto whereby said second end of said cable is connected to said ceiling texturing means at a head connector and whereby said head sleeve is larger than said cable sleeve to allow said head sleeve to move over said cable sleeve; and j) first spring attached to said second connector on said cable sleeve and said head connector on said ceiling texturing means such that said cable passes through said first spring and whereby when the piston rod moves in a direction toward said crank it pulls on said cable, and also forces said ceiling texturing means toward said crank, thereby compressing said first spring, and when said piston rod moves away from said crank, compression is taken off of said first spring and said first spring forces said ceiling texuring means in the direction away from said crank imparting a reciprocating motion to said head sleeve and said ceiling texturing means.

22. The ceiling texturing device of claim 21, further comprising:

a) a slot cut in said head sleeve; and b) a guide attached to said cable sleeve such that said guide travels in said slot and such that when said head sleeve moves in a reciprocating motion a twisting motion is imparted to said ceiling texturing means.

23. The ceiling texturing device of claim 21, further comprising:

a) a bracket attached to said head sleeve and said cable sleeve; and b) a second spring attached between said piston rod and said bracket whereby said second spring keeps a tension on said piston rod and said wrist pin.

* * * * *